United States Patent [19]

Goebel

[11] 4,013,114

[45] Mar. 22, 1977

[54] ARTICULATED NETTING, PARTICULARLY FOR SHUTTERING

[76] Inventor: Klaus Karl-Heinz Goebel, 4, rue Leopold, 4650 Herve, Belgium

[22] Filed: July 26, 1976

[21] Appl. No.: 708,687

Related U.S. Application Data

[63] Continuation of Ser. No. 508,692, Sept. 23, 1974, abandoned.

[30] Foreign Application Priority Data

Sept. 25, 1973 Belgium ..... 44318

[52] U.S. Cl. ..... 160/330; 52/109; 135/4 R

[51] Int. Cl.[2] ..... A47H 1/00; E04H 12/18

[58] Field of Search ..... 160/84 AV; 135/3 A, 135/4; 52/109

[56] References Cited

UNITED STATES PATENTS

| | | | |
|---|---|---|---|
| 714,100 | 11/1902 | Cross | 52/109 |
| 1,222,200 | 4/1917 | Grandiretti | 52/109 |
| 2,865,387 | 12/1958 | Annibaldi | 135/DIG. 3 |
| 3,496,687 | 2/1970 | Greenberg et al. | 52/109 |
| 3,559,353 | 2/1971 | Fartridge | 52/109 |
| 3,710,806 | 1/1973 | Kelly et al. | 52/109 |
| 3,830,031 | 8/1974 | Soisson | 52/109 |

FOREIGN PATENTS OR APPLICATIONS

| | | | |
|---|---|---|---|
| 1,434,526 | 12/1968 | Germany | 52/109 |
| 376,365 | 10/1920 | Germany | 52/109 |

*Primary Examiner*—Paul R. Gilliam
*Assistant Examiner*—V. N. Sakran
*Attorney, Agent, or Firm*—Ernest G. Montague; Karl F. Ross; Herbert Dubno

[57] ABSTRACT

The present invention relates to an articulated netting of annular shape making it possible for example to adapt the size of shuttering to the various diameters of round, conical or other constructions.

1 Claim, 6 Drawing Figures

E
N1
B
P
E
b
P

N2
E
N1
B
b
P
P
E

ARTICULATED NETTING, PARTICULARLY FOR SHUTTERING

This is a continuation of application Ser. No. 508,692, filed Sept. 23, 1974 now abandoned.

In the case if known sliding shutterings, during the raising of the construction, tie rods are moved, adapting the size of the shuttering to the new diameter.

As the circumference alters over the height of the structure, the shuttering panels have to be able to extend one on another. The frame created by connection of the inner and outer shutterings, is raised by means of a hydraulic or manual hoist and comprises a main shuttering panel into which, from each side, the sliding panels are introduced. When there are substantial changes in diameter, in order to gain space, another fixed panel is inserted between two sliding panels in the middle of two frames.

At the time of raising the shuttering, the moment comes when the sliding panels are drawn in and when there is no longer any possibility of further diminishing the circumference. At present, it is necessary to dismantle the central panel, withdraw the sliding panels and connect them to one another in order to be able to continue to raise the structure further.

The system of tie rods currently used is needed so that the shuttering forms a complete round, so that the panels are adapted to any diameter and so that the assembly is of good stability. Furthermore, the thickness of the walls to altered, going for example from 70 cm at the foundations to 10 cm at the top of the structure.

With known shutterings, the working scaffolding has to be permanently altered.

In order to remedy the aforesaid drawbacks of the sliding shutterings for example, it appeared advantageous according to the invention to create an articulated lattice or netting, characterised in that it is of annular form and in that the meshes of the netting are constituted by arcs of circles, the centres of which are disposed at equal distances on the circumference of a circle of the same diameter.

In the annular articulated netting according to the invention, the nodes of articulation are disposed on the circumferences of concentric circles and on radii.

In the event of the netting being used for shutterings, shuttering panels are mounted on the articulation nodes of the outer circumference of the netting.

According to the invention, the outer circumference nodes of the netting each carry a bar for supporting a shuttering panel element. The bar is mounted so that it can pivot on its end node in order that, by pivoting, its panel element can be brought to bear with pressure against the neighbouring panel element.

In order that the invention may be better understood, it is now illustrated, solely by way of example, in the appended drawings, in which.

In order to draw the outline of a netting according to the invention, one starts from a circle of centre M and on the circumference of this circle, according to an angle $\alpha$ at the centre chosen, and the upper limit of which will be 60°, divisions are traced. Each point M1, M2, M3 . . . Mn obtained on this circumference serves as the centre for a circle of a diameter equal to that of the circle M and the circumference of which intersects with the circumference of the said circle M, forming nodes N. All these nodes are located on circles of the same centre M and on radii. Moreover, the diagonals between the nodes are of the same length, since the circles M1, M2 . . .Mn are cut in the same ratio by the angle at the centre of the circle M.

Taking a portion of this outline (arc of a circle) constituted by intersecting circumferences, the result is the curvature to be given to the articulated elements E which, by being assembled, are to provide the netting according to the invention.

Figure 1:
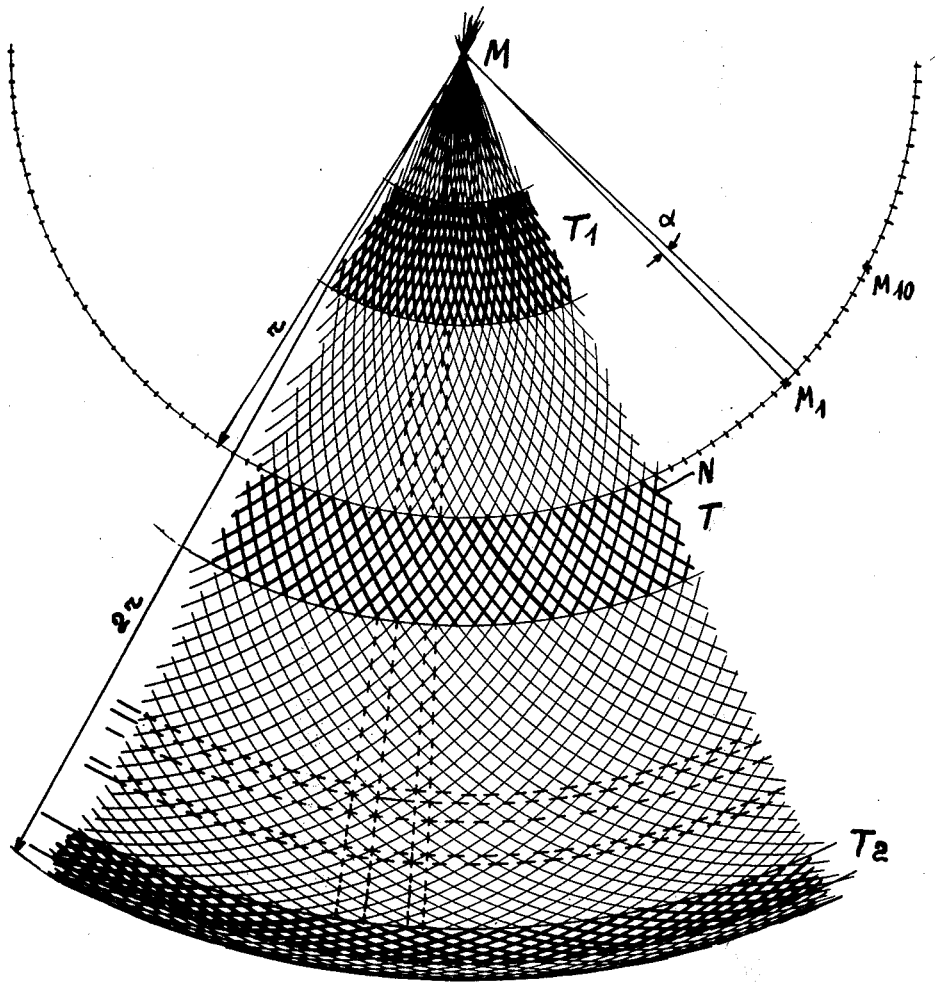
FIG. 1 shows a diagram of the structure of a netting according to the invention.

The netting obtained is round in its external form and in its internal form, with a diameter variable by its articulated nodes, without portions having to be added or removed. FIG. 1 shows a portion of netting in an intermediate position T and in two extreme positions T1, T2.

Of course, the smaller the angle $\alpha$ chosen at the centre, the greater modification of diameter is possible for the articulated netting.

Figure 2:
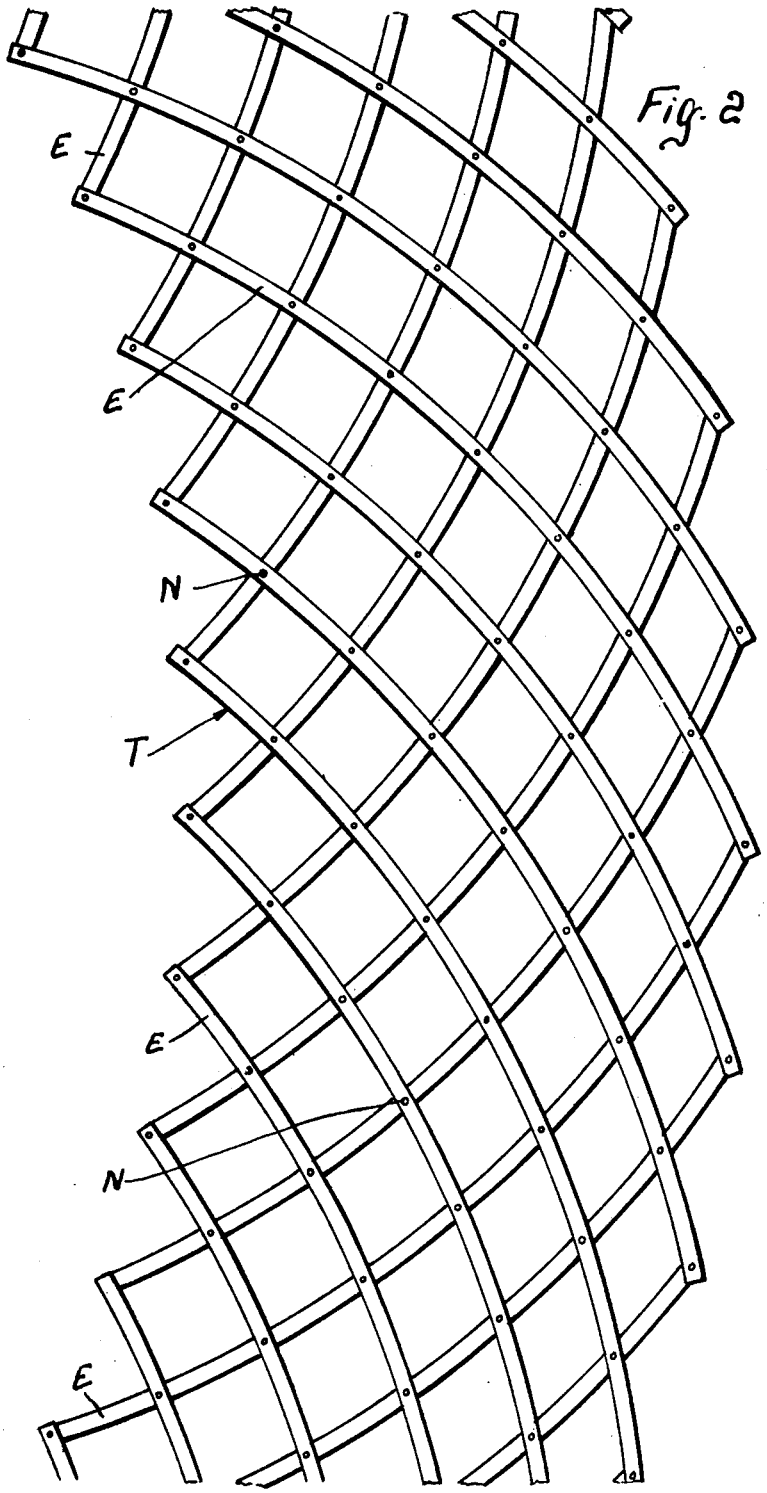
FIG. 2 is a partial view of the articulated netting.

A portion of netting T is illustrated on a larger scale in FIG. 2.

Figure 3:
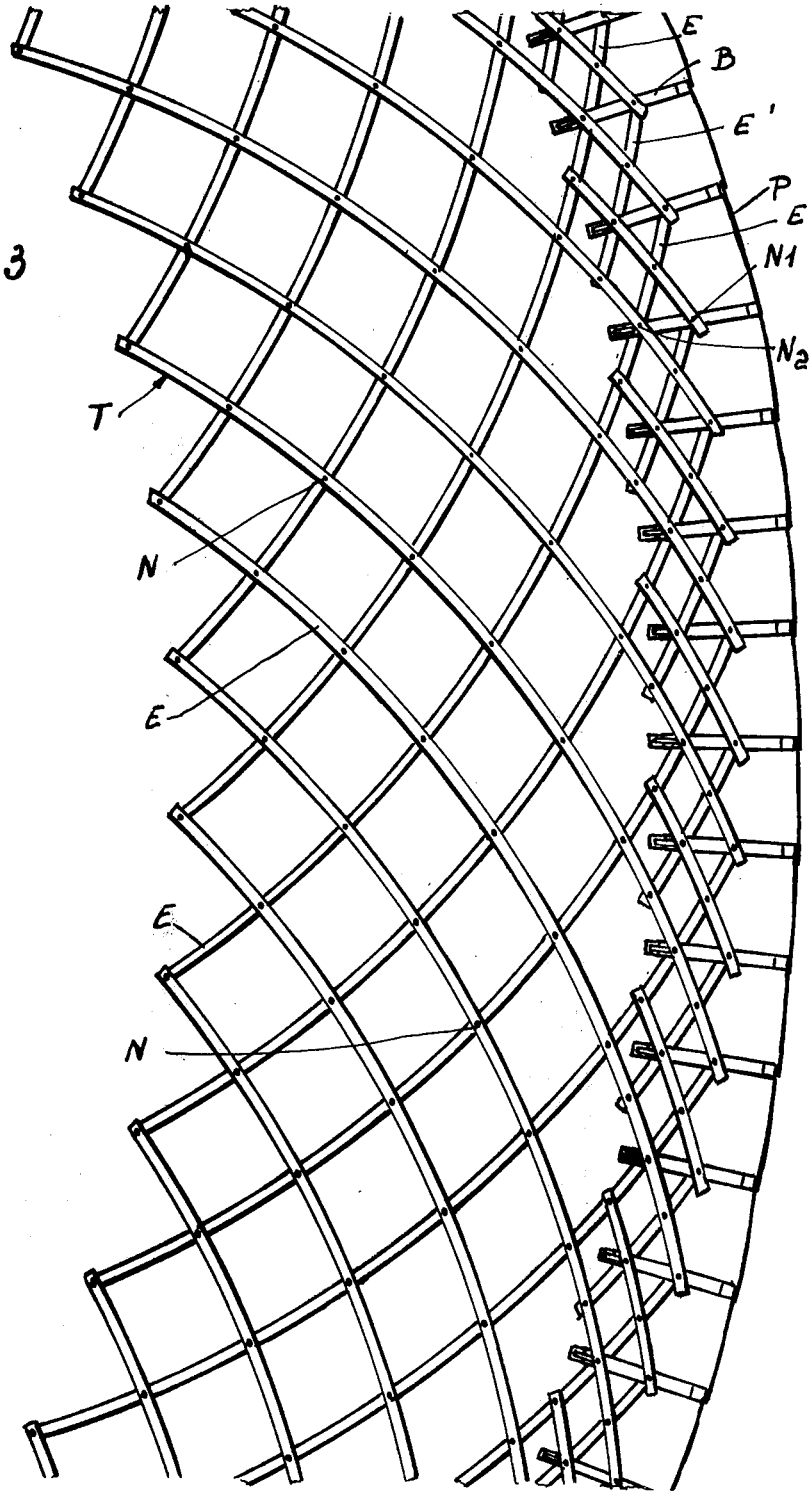
FIG. 3 is a view similar to that of FIG. 2 showing the positioning of the panels in the case of shuttering.
Figure 4:
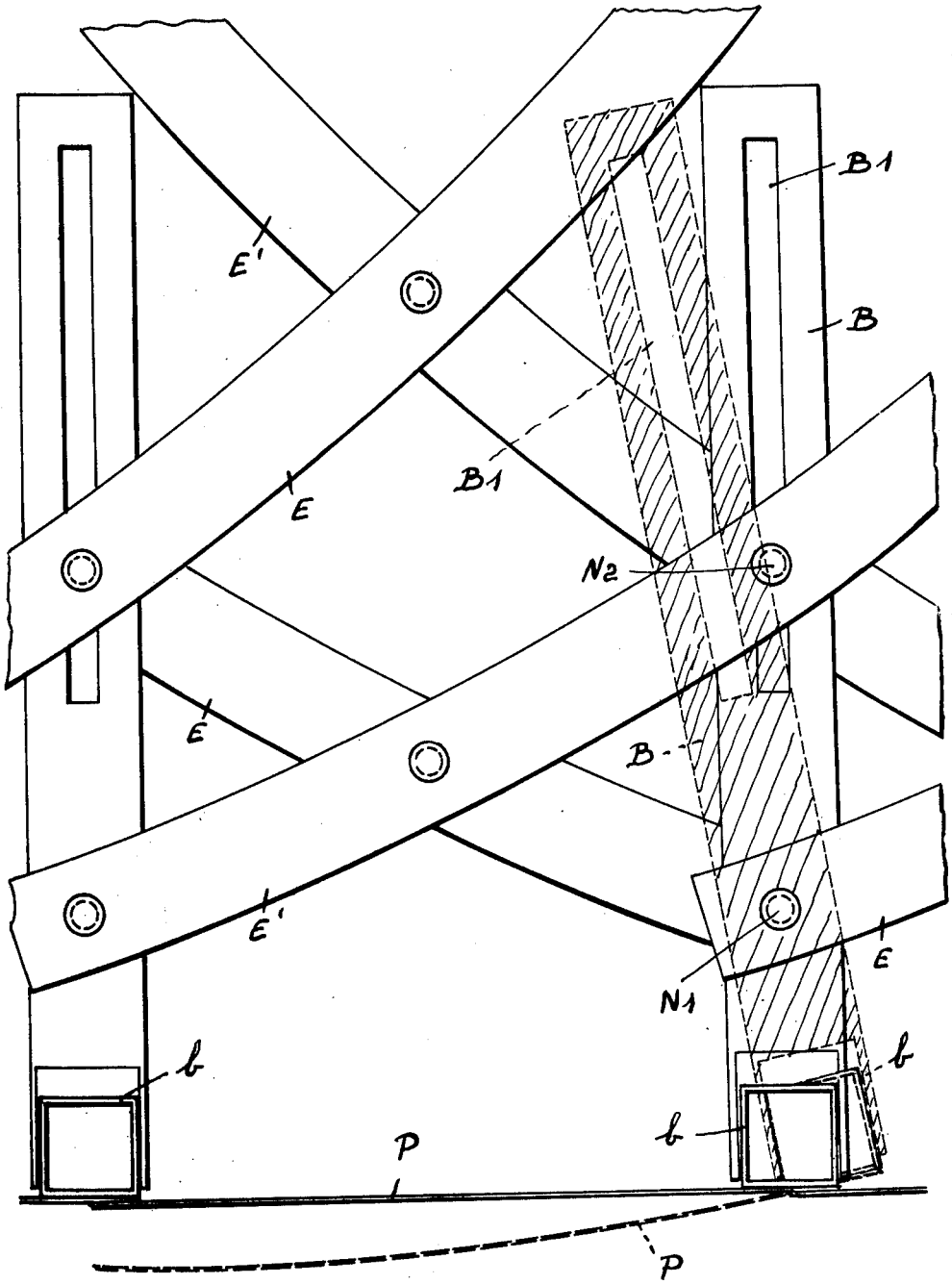
FIGS. 4 to 6 show views of details from FIG. 3.

FIG. 3 shows the same portion of netting with sliding shuttering panels. On its outer circumference, the netting is provided with support bars B for supporting sliding panels P which straddle one another to provide for sealing-to gatness. These bars are pivotably mounted on an end node N1 so that, by pivoting during assembly, a slot B1 can be moved into a position where it corresponds to the radially just preceding articulation node N2, and the shuttering panel P can be applied with pressure against the neighboring panel. The conformation of these plates and their fixing are very simple. The slot B1 allows a fixing of the bar at N2, however open the netting may be.

These shuttering panels straddle one another so as always to form a single fluid-tight surface, whatever the diameter of the outside circumference of the articulated netting.

Figure 5:
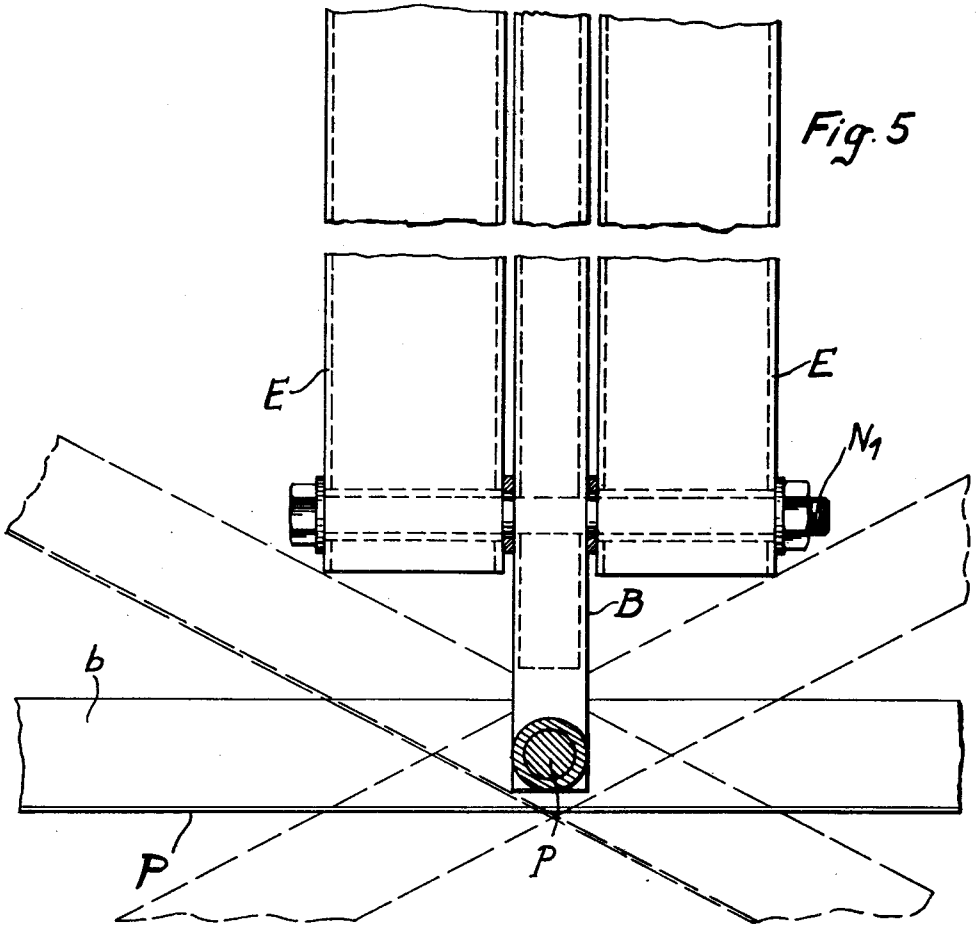
Figure 6:
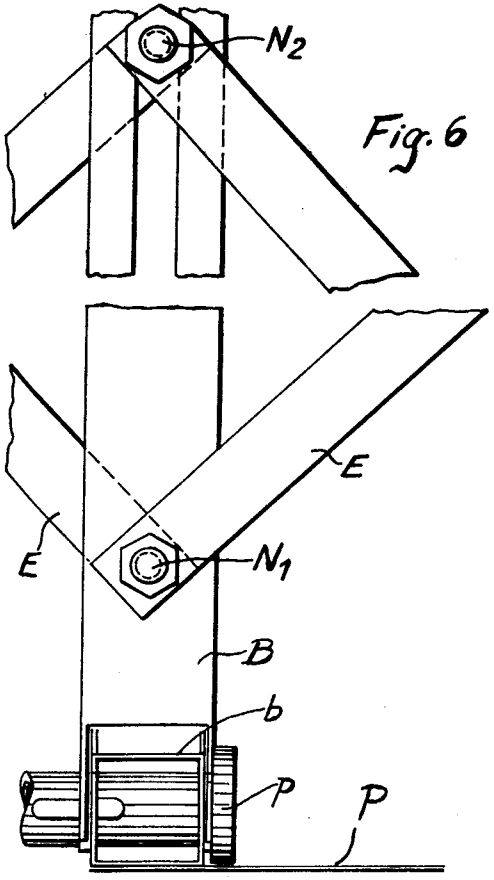

In order to facilitate assembly of the bars B, intermediate articulated elements E′ (FIG. 3) are provided on the netting. Furthermore, the sliding plates P are mounted on the support bars B so that they may be pivoted by means of bars *b* and pivots *b* (FIGS. 5 and 6).

In order to modify the diameter of the external or internal circumference of the netting, a few tangential tie rods (not shown) are provided. These spaced internodal junction elements may either bring these nodes closer to each other and so diminish the said diameter or may space them apart and consequently increase the said diameter.

The scaffolding for working with such a sliding shuttering has the same horizontal pattern and requires no modification during course of construction.

Of course, an annular articulated netting according to the invention may be used in various applications other than shuttering, for example for the making of scaffolds for demolition works.

I claim:

1. A lattice structure for shuttering comprising:

an annulus composed of two arrays of mutually crossing bars, each bar being in the form of a circular arc of the same predetermined radius of curvature, said bars having centers of curvature disposed at equal distances from one another along the circumference of an imaginary circle of the same radius, the bars of one array being curved in a direction opposite to that of the bars of the other array, pivots articulating the bars of both arrays at their crossover points, each of the pivots forming an articulation node, the articulation nodes being disposed along concentric circles and radii extending from the center of said concentric circles, a plurality of relatively movable panels mounted on said bars along the outer periphery of the structure at respective articulation nodes, a respective support bar for each of said panels pivotally connected to the respective articulation node and extending along a respective radius from said center of said concentric circles, each of said bars being provided with a slot, and an arcuate further bar forming part of the lattice structure at said outer periphery and having a pivot received in the respective slot.

* * * * *